US007992730B2

(12) United States Patent
Huang

(10) Patent No.: US 7,992,730 B2
(45) Date of Patent: Aug. 9, 2011

(54) PILLAR INSERTION COMBINATION RACK SYSTEM

(76) Inventor: Li-Hsu Huang, Changhua (TW)

( * ) Notice: Subject to any disclaimer, the term of this patent is extended or adjusted under 35 U.S.C. 154(b) by 307 days.

(21) Appl. No.: 11/701,554

(22) Filed: Feb. 2, 2007

(65) Prior Publication Data

US 2008/0185355 A1 Aug. 7, 2008

(51) Int. Cl.
*A47B 43/00* (2006.01)
*A47B 47/00* (2006.01)
*A47B 57/00* (2006.01)

(52) U.S. Cl. ..... 211/187; 108/147.13

(58) Field of Classification Search ..... 211/187, 211/186, 188, 189, 181.1, 183, 134, 153; 108/107, 109, 147.11, 147.15, 147.17, 147.12–147.14; 248/249, 302; 403/387, 390, 398, 399
See application file for complete search history.

(56) References Cited

U.S. PATENT DOCUMENTS

| | | | | | |
|---|---|---|---|---|---|
| 719,060 | A | * | 1/1903 | Thomas | 108/76 |
| 719,441 | A | * | 2/1903 | Davison | 108/163 |
| 844,067 | A | * | 2/1907 | Webb | 211/51 |
| 915,002 | A | * | 3/1909 | Werner | 108/156 |
| 3,113,400 | A | * | 12/1963 | Emond | 47/45 |
| D207,437 | S | * | 4/1967 | Oliver | D6/465 |
| 3,523,805 | A | * | 8/1970 | Maslow | 108/147.13 |
| 4,527,490 | A | * | 7/1985 | Tipton et al. | 108/192 |
| 4,629,077 | A | * | 12/1986 | Niblock | 211/187 |
| 5,797,503 | A | * | 8/1998 | Stevens et al. | 211/187 |
| D471,033 | S | * | 3/2003 | Yamaguchi | D6/465 |
| D471,381 | S | * | 3/2003 | Yamaguchi | D6/465 |
| 6,695,156 | B1 | * | 2/2004 | Wang | 211/187 |

FOREIGN PATENT DOCUMENTS

JP 11137386 A * 5/1999

* cited by examiner

*Primary Examiner* — Darnell M Jayne
*Assistant Examiner* — Stanton L Krycinski
(74) *Attorney, Agent, or Firm* — Jackson IPG PLLC; Demian K. Jackson

(57) ABSTRACT

An improved construction pillar insertion combination rack made of metal wire material in a rectangular or polygonal form and in a single layer or multiple layers includes multiple side frames, multiple pillars, multiple clamping members, and a top; each limitation corner of the rack comprised of two rings concentrically arranged with the diameter of the upper ring smaller than that of the lower ring; each side frame including an upper and a lower support rods; a connection rod usually made in a waveform being disposed at where between and soldered to both of the upper and the lower support rods; each pillar containing multiple sections with a circumferential slot being defined by any two abutted sections; the pillar being secured with the clamping member at where it to be inserted into the limitation corner; and the top usually related to a mesh being placed on the frame of the rack; alternatively, an upper frame with multiple upper rings of the limitation corner and a lower frame with multiple lower rings of the limitation corner may be separately made in continuous form to be spot soldered at where both ends meet.

2 Claims, 6 Drawing Sheets

Fig. 1-A (Prior Art)

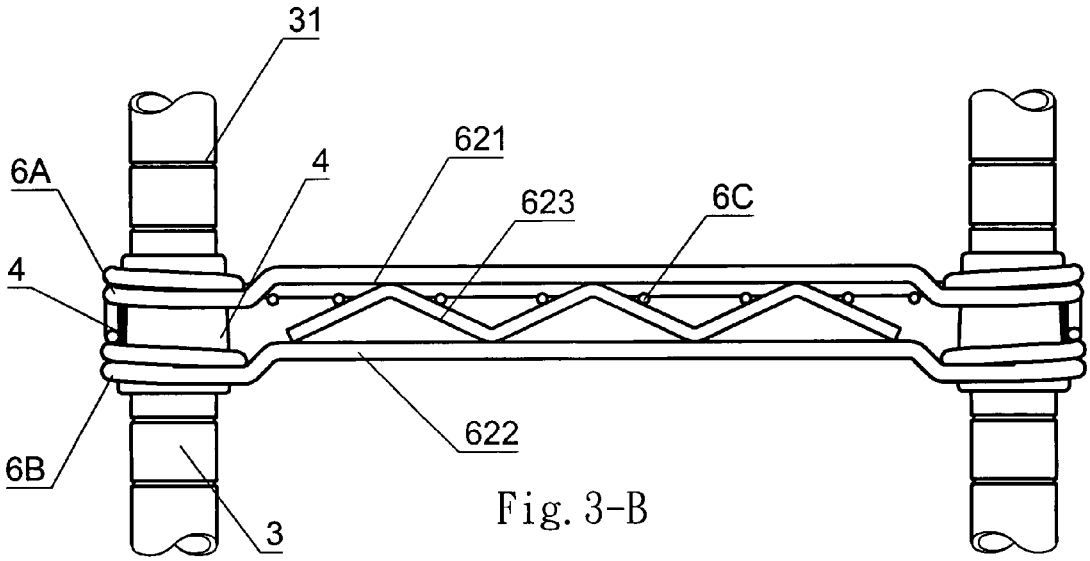
Fig. 3-B
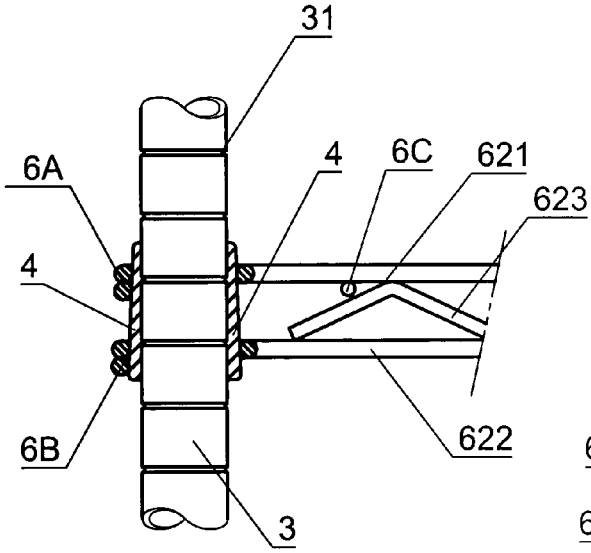
Fig. 3-C
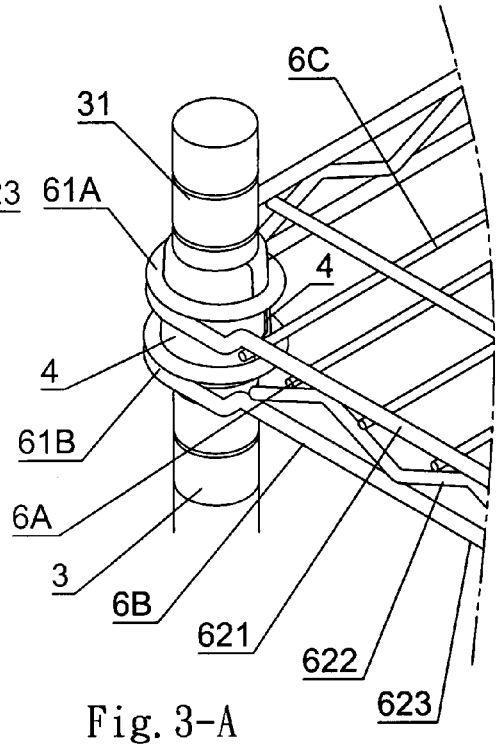
Fig. 3-A

PILLAR INSERTION COMBINATION RACK SYSTEM

BACKGROUND OF THE INVENTION (a) Field of the Invention

The present invention is related to a pillar insertion combination rack system, and more particularly to one allows fast assembly by having each pillar comprised of multiple sections with each section disposed with a circumferential slot to be secured at a given point by means of a pair of clamping members; each limitation corner of a rectangular or polygonal rack is comprised of a lower ring and an upper ring; each pillar is inserted into the limitation corner of the rack; wherein the diameter of the upper ring is smaller than that of the lower ring with both rings disposed concentrically; each side frame of the rack includes an upper support rod and a lower rod joined to each other with a connection rod; and two abutted side frames of the rack are formed at a right angle to each other and welded or secured with coils of wire at the limitation corner of the rack.

(b) Description of the Prior Art

A conventional pillar insertion combination rack as illustrated in FIGS. 1 and 1-A of the accompanying drawing, a rectangular rack 2 at its four corners each inserted with a pillar 3; each pillar includes multiple equally spaced sections with a circumferential slot 31 defined by any two abutted sections for locating purpose; a limitation sleeve 22 is each disposed to four corners of the rack 2; at a given location of each pillar 3 where to be inserted into its respective limitation sleeve 22 is secured with a pair of locating clamps 4 by biting two circumference slots; and each pillar is then with its clamped sections inserted into its respective limitation sleeve 22 thus to secure the rack 2 with four pillars respectively at four corners of the rack 2. Multiple racks may be assembled on those same four pillars as required. The prior at for allowing convenient disassembly, assembly and location adjustment has been popularly applied for displaying commodities in a shop or for glove compartment at home.

In the construction of the pillar insertion combination rack as illustrated, each side frame 21 of the rack 2 includes an upper support rod 211 and a lower support rod 212; a connection rod 213 usually made of metal wire material in a wave form is first soldered to both of the upper and the lower support rods 211, 212; the limitation sleeve 22 is related to a hollow cone with a smaller top and larger bottom; each of both ends from each upper support rod 211 and each lower support rod 212 provides a soldering point P for soldering both ends of each side frame 21 to their respectively limitation sleeves 22 to make a frame 2A; and a top 23 usually a mesh is placed into and confined by the frame 2A to complete the production of the rack 2. However, molding of the limitation sleeve 22 consumes much of costs and materials, and as many as sixteen points needs the soldering job to connect four limitation sleeves 22 to four side frames 21 for the production of a rectangular rack 2. Other than minute and complicated soldering process and high process costs, soldering precision and fastness demand are potential factors contributing to the flaws of higher price, difficulties in manufacturing, and higher nonconformity rate found with the rack 2 of the prior art.

SUMMARY OF THE INVENTION

The primary purpose of the present invention is to provide an improved construction of a pillar insertion combination rack that is simple in construction, and precise and consistent in dimension to effectively replace equivalent function provided by the limitation cone sleeves of the prior art for delivering better economic benefits and upgrading manufacturing efficiency of the rack. To achieve the purpose, each limitation corner of the rack is comprised of an upper ring and a lower ring concentrically arranged with the diameter of the upper ring smaller than that of the lower ring; each pillar comprised of many sections with a circumferential slot defined by any two abutted sections; a clamping member made of two identical halves facing each other secures the pillar at where it to be inserted into the limitation corner by biting two circumferential slots; and the limitation corner may be continuously molded in automated process using a metal wire material.

Another purpose of the present invention is to provide an improved construction of a pillar insertion combination rack that is capable of reducing soldering requirements in the manufacturing process thus to significantly upgrade manufacturing efficiency and optimal economic benefits of lowering production costs. To achieve the purpose, the limitation corner is made of metal wire material in continuous fashion and folded automatically before performing spot soldering at where the metal wire ends; an upper frame with multiple upper rings of limitation corners, a lower frame with multiple lower rings of limitation corners, and multiple support rods each usually made in a waveform are separately processed before soldering the support rods at where between and to the upper and the lower frames with each limitation corner containing the upper ring and the lower ring concentrically arranged with the diameter of the upper ring smaller than that of the lower ring. Accordingly, both of the upper and the lower frames of the rack are each given a single spot soldering to provide the most reinforced and simplest construction for the rack.

BRIEF DESCRIPTION OF THE DRAWINGS

FIG. 1A is a sectional view showing a local part of the combination taken from FIG. 1.

FIG. 2A is a sectional view showing a local part of the combination taken from FIG. 2.

FIG. 3A is a perspective view of an enlarged local part of the second preferred embodiment of the present invention.

FIG. 3B is a side view of the combination of the second preferred embodiment of the present invention.

FIG. 3C is a side view of the combination of the second preferred embodiment of the present invention.

DETAILED DESCRIPTION OF THE PREFERRED EMBODIMENTS

Figure 2:
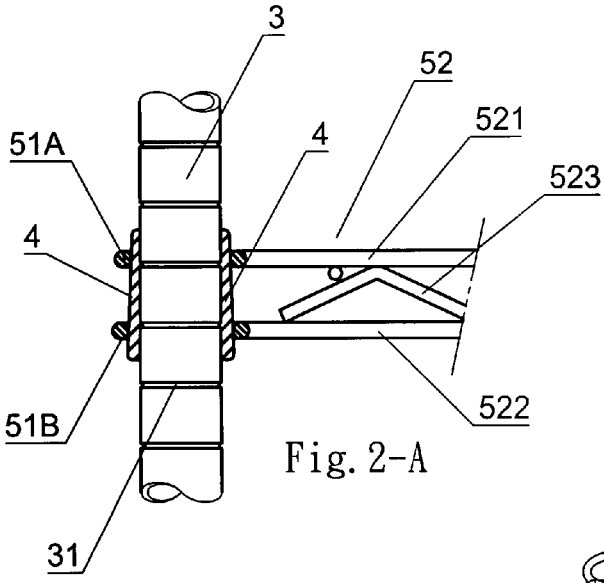
FIG. 2 is an exploded view of a construction of a first preferred embodiment of the present invention.
Figure 2:
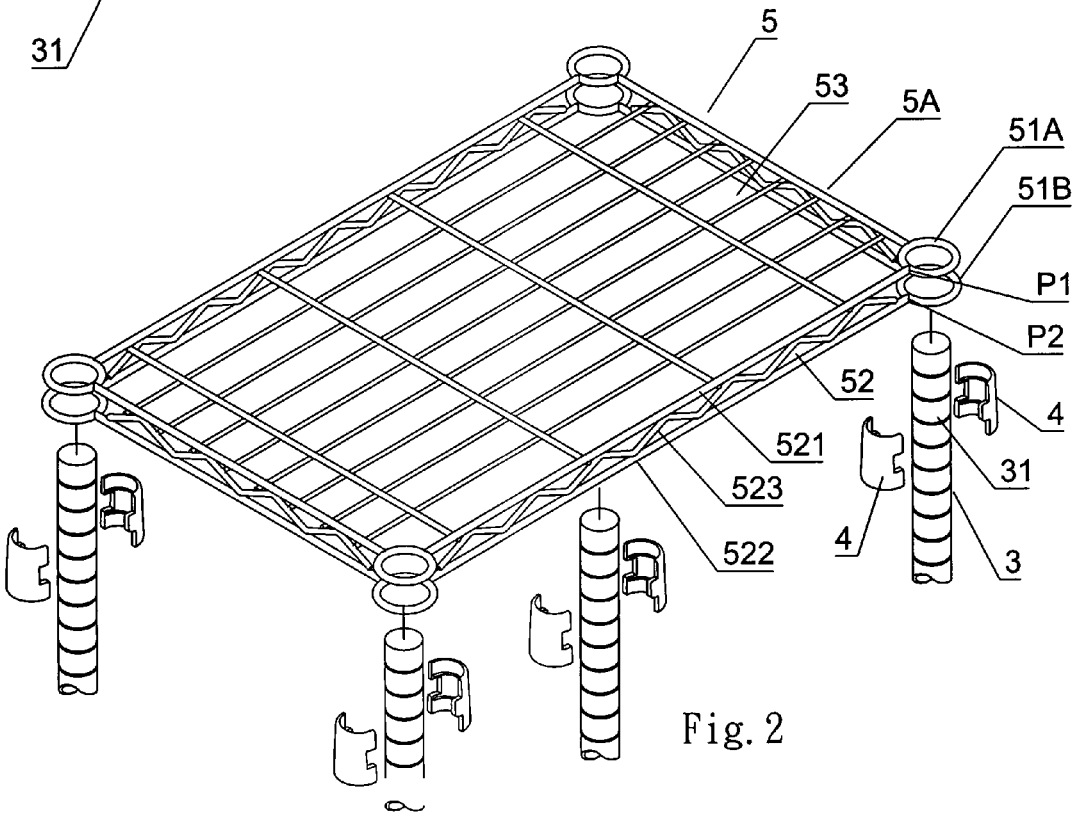
Figure 3:
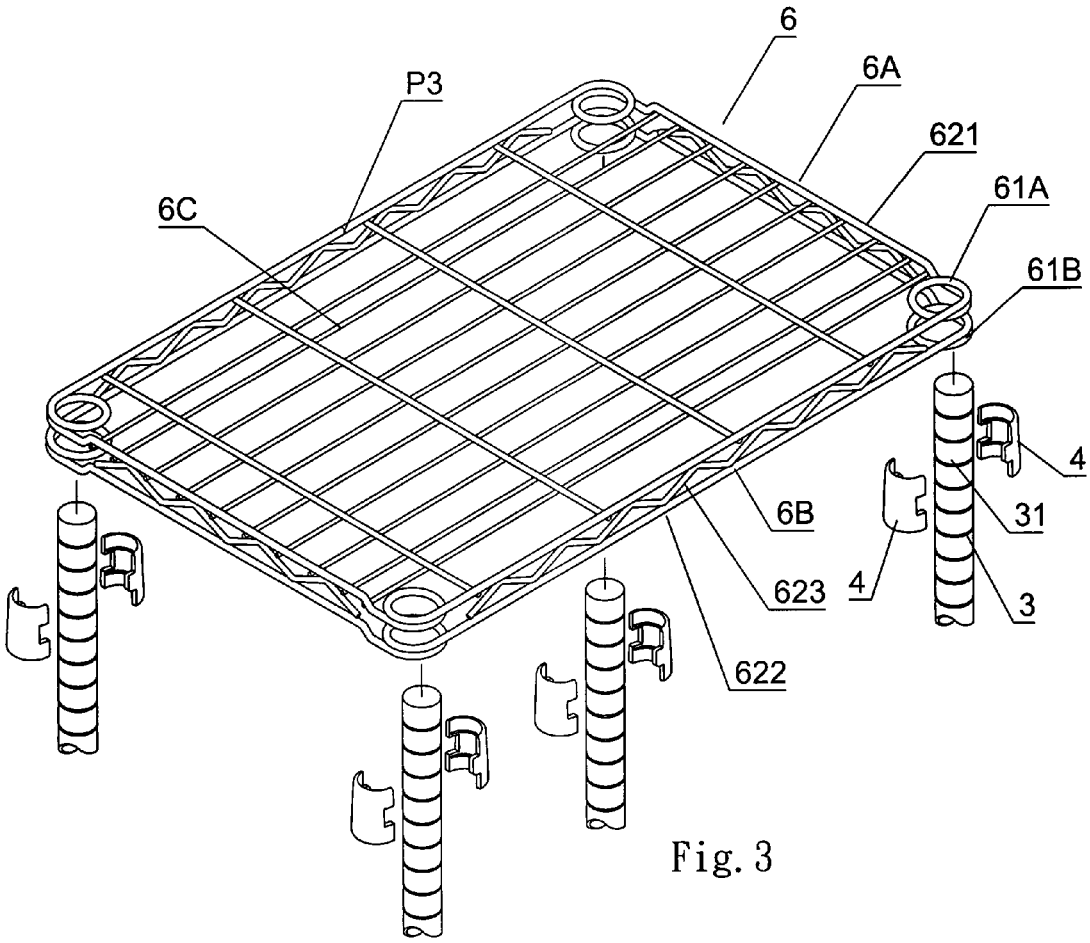
FIG. 3 is an exploded view of a construction of a second preferred embodiment of the present invention.

Referring to FIGS. 2 and 2A for a first preferred embodiment of the present invention, a rectangular or a polygonal rack 5 (a rectangular rack in this preferred embodiment) includes four limitation corners, a top 53 usually made in a mesh form, four side frames 52, four pillars 3, and four sets of clamping members 4. Wherein, each limitation corner of the rack 5 is comprised of an upper ring 51A and a lower ring 51B each made of metal wire material; the diameter of the upper ring 51A is smaller than that of the lower ring 51B and both rings 51A, 51B are concentrically disposed; each side frame 52 also made of metal wire material includes an upper support rod 521 and a lower support rod 522 parallel with each other, and a connection rod usually made in a waveform is disposed between and soldered to both support rods 521, 522; each of both ends of the upper support rod 521 defines a soldering point P1, and each of both ends of the lower support rod 522 defines another soldering point P2; both ends of the upper support rod 521 are respectively soldered two upper rings 51A of the limitation corners at points P1, and both end of the lower support rod 522 are respectively soldered to two lower rings 51B of the limitation corners at points P2; each shorter side frames 52 and each longer side frames 52 are soldered at right angle to each other to form the frame 5A of the rack 5; and the top 53 is placed in the frame 5A.

Figure 1:
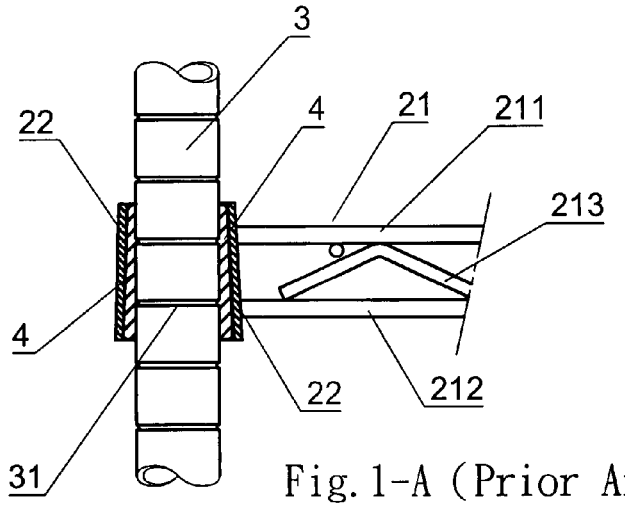
Fig. 1 (Prior Art)
FIG. 1 is an exploded view of a construction of the prior art.
Figure 1:
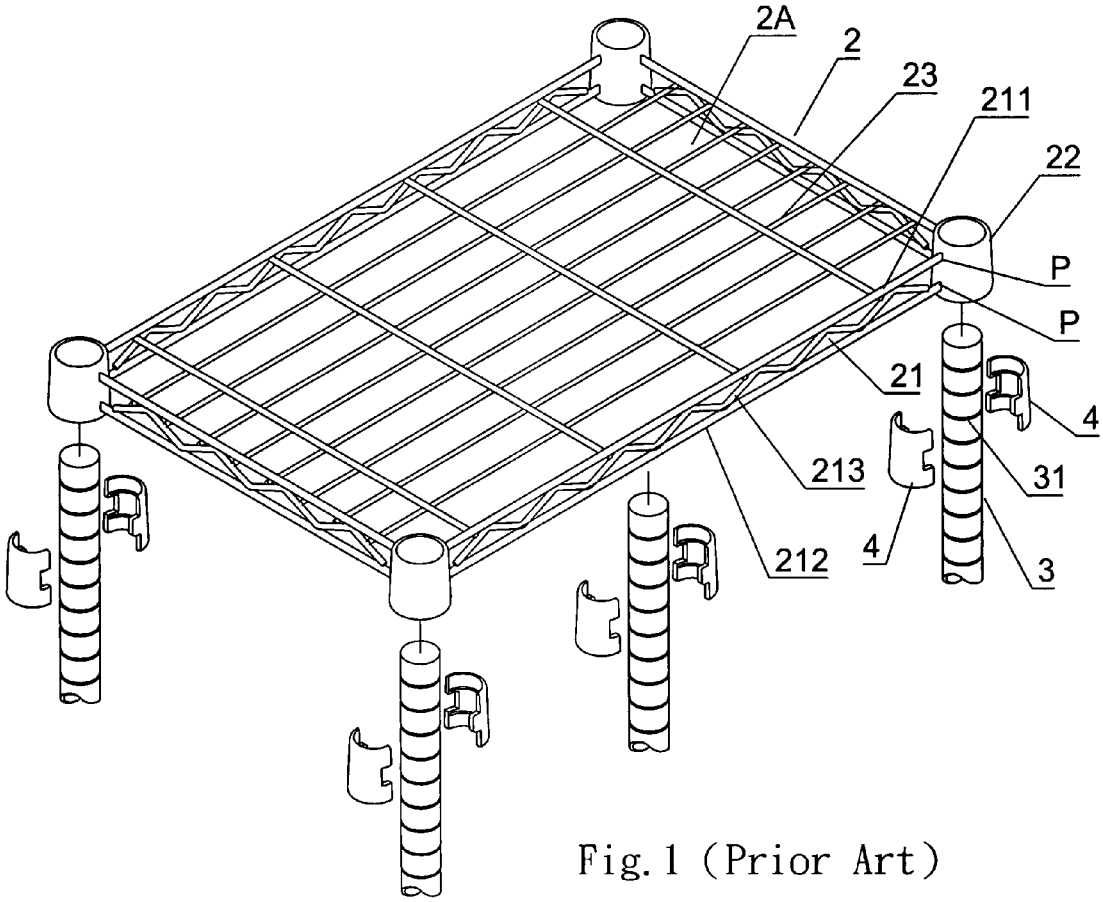
Fig. 1 (Prior Art)

Each pillar 3 contains multiple sections with a circumferential slot 31 defined by any two abutted sections. At a given point of the pillar 3 where to be inserted into its respective limitation corner of the frame 5A is secured with a set of clamping member 4; each clamping member 4 is comprised of two identical halves to secure the pillar 3 by facing each other to bite two circumferential slots 31; and the pillar 3 is inserted with its clamped portion into and secured in the lower ring 51B and the upper ring 51A in sequence. The design of the limitation corner of the present invention replaces the larger hollow limitation cone sleeve 22 as illustrated in FIG. 1 of the prior art to effectively reduce production cost for achieving optimal economic benefits.

Figure 4:
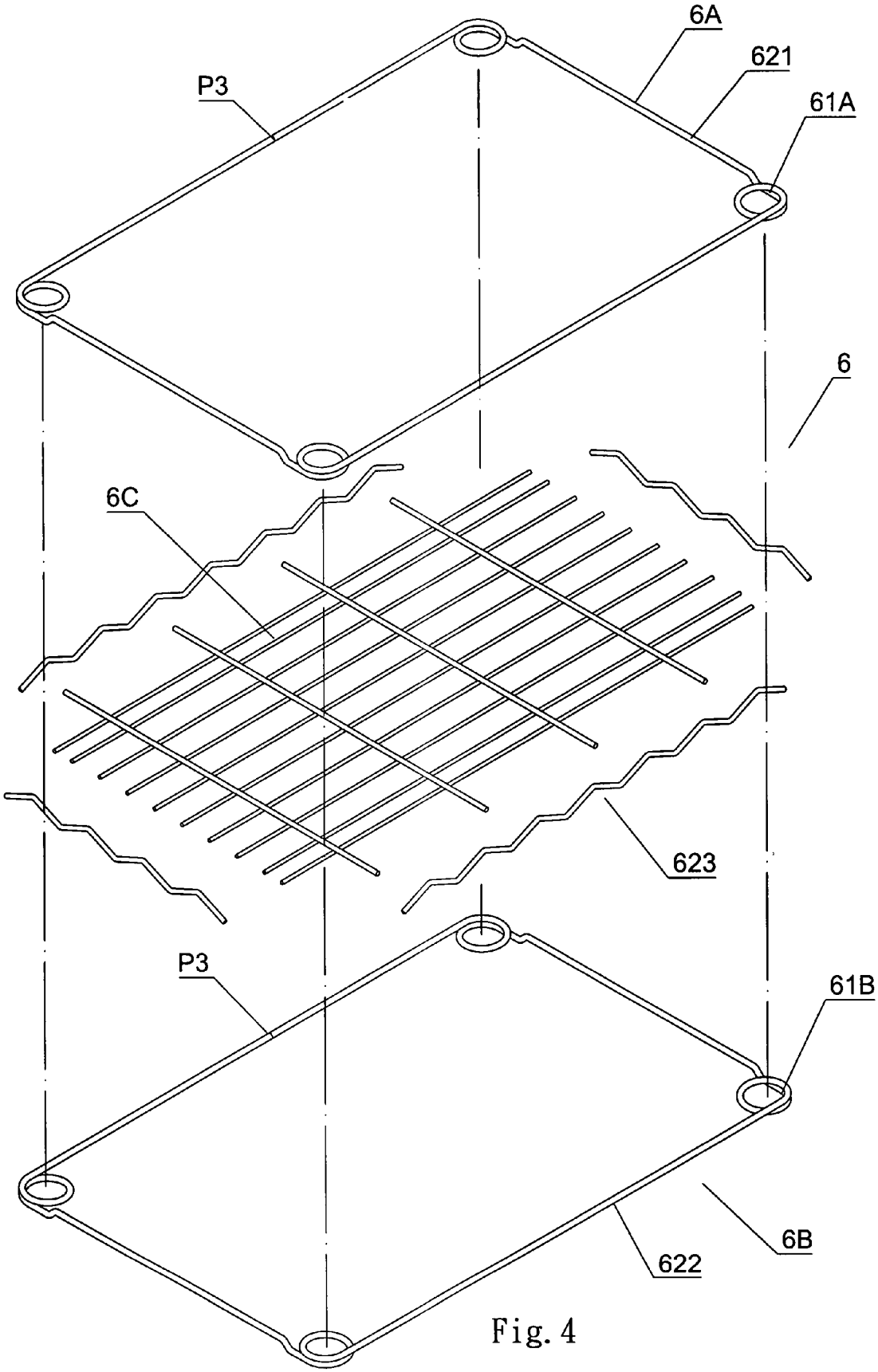
FIG. 4 is an exploded view showing a local part of the second preferred embodiment of the present invention.

Now referring to FIGS. 3, 3A, 3B, and 3C, a second preferred embodiment of the present invention related to a pillar insertion combination rack 6 includes an upper frame 6A, a lower frame 6B, four pillars 3, four sets of clamping member 4, and a top 6C. As also illustrated in FIG. 4, a metal wire is continuously coiled and folded in automatic mode to form an upper frame 6A containing four upper rings 61A at each limitation corner and four upper side frames 621 in an integral part; another length of the same metal wire is again continuously coiled and folded in automatic mode to form a lower frame 6B containing four lower rings 62A at each limitation corner and four lower side frames 622 in an integral part; each of both of the upper frame 6A and the lower frame 6B is performed a spot soldering at a point P3 where both ends of the metal wire meet. The diameter of the upper ring 61A is smaller than that of the lower ring 61B.

Figure 5:
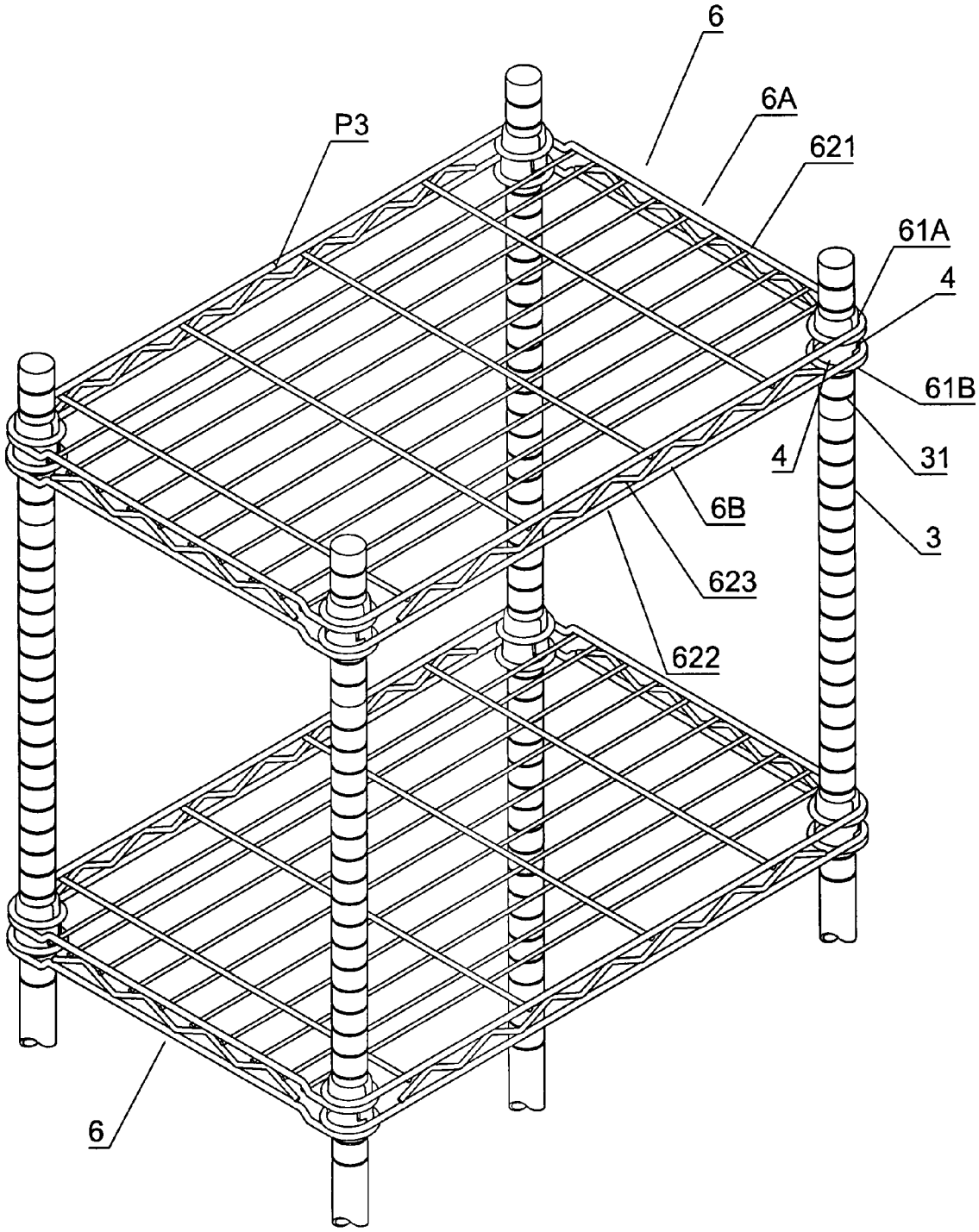
FIG. 5 is a perspective view showing the second preferred embodiment as assembled.

A connection rod 623 made of the same wire material is disposed between and soldered to both of the upper side frame 621 and the lower frame 622 respectively from the upper frame 6A and the lower frame 6B. The top 6C usually a mesh is placed in the upper frame 6A. Each pillar 3 contains multiple sections with a circumferential slot 31 defined by any two abutted sections. At a given point of the pillar 3 where to be inserted into its respective limitation corner of the limitation corner is secured with a set of clamping member 4; each clamping member 4 is comprised of two identical halves to secure the pillar 3 by facing each other to bite two circumferential slots 31; and the pillar 3 is inserted with its clamped portion into and secured in the lower ring 61B and the upper ring 61A in sequence. Finally four pillars 3 are inserted into their respective limitation corners to form the rack 6 as illustrated in FIG. 5.

Both of the upper and the lower frames 6A, 6B of the rack 6 are each given a single spot soldering to provide the most reinforced and simplest construction for the rack to minimize the demand of soldering job to significantly upgrade manufacturing efficiency and realize optimal economic benefits by reduction of production cost.

The prevent invention provides an improved structure of a pillar insertion combination rack system, and the application for a utility patent is duly filed accordingly.

I claim:

1. A pillar insertion combination rack made in a polygonal shape and a single layer or multiple layers includes:

an upper frame, a lower frame, a top, multiple pillars, multiple clamping members, and multiple connection rods; wherein the upper frame is made of a first metal wire material in continuous form coiled at each corner of the upper frame to define an upper ring at each corner and running straight between any two adjacent corners, both ends of the first wire being spot welded where both ends of the first metal wire material meet; the lower frame being made of a second metal wire material in continuous form coiled at each corner of the lower frame to define a lower ring at each corner and running straight between any two adjacent corners, both ends of the second wire being spot welded where both ends of the second metal wire material meet; the diameter of each upper ring being smaller than that of the respective lower ring; each pillar containing multiple sections with a circumferential slot defined between any two abutted sections; each clamping member comprised of two identical halves facing each other so as to secure to the respective pillar at where the respective pillar is configured to be inserted into both the respective upper ring and the respective lower ring by biting two circumferential slots of the respective pillar; the connection rods made of third metal wire material shaped in a waveform and disposed between and soldered to both of the upper frame and the lower frame between each two adjacent corners with both of the upper ring and the lower ring at each corner being concentrically arranged; each pillar with its clamped portion being inserted into and through both the respective lower ring and the respective upper ring; and the top being placed in the upper frame of the rack.

2. The pillar insertion combination rack of claim 1, wherein the first and second metal wire material forming the upper and lower frames respectively is continuous so as to form four rings with one ring arranged at each corner of the rack.

* * * * *